US009869516B2

(12) United States Patent
Satoh et al.

(10) Patent No.: US 9,869,516 B2
(45) Date of Patent: Jan. 16, 2018

(54) CONTINUOUS HEATING FURNACE

(71) Applicants: Kimiyoshi Satoh, Tokyo (JP); Toshiyuki Suda, Tokyo (JP); Toshiro Fujimori, Tokyo (JP); Masao Aihara, Tokyo (JP)

(72) Inventors: Kimiyoshi Satoh, Tokyo (JP); Toshiyuki Suda, Tokyo (JP); Toshiro Fujimori, Tokyo (JP); Masao Aihara, Tokyo (JP)

(73) Assignee: IHI CORPORATION (JP)

( * ) Notice: Subject to any disclaimer, the term of this patent is extended or adjusted under 35 U.S.C. 154(b) by 55 days.

(21) Appl. No.: 14/178,524

(22) Filed: Feb. 12, 2014

(65) Prior Publication Data

US 2014/0220502 A1 Aug. 7, 2014

Related U.S. Application Data

(63) Continuation of application No. PCT/JP2012/071789, filed on Aug. 29, 2012.

(30) Foreign Application Priority Data

Sep. 5, 2011 (JP) ..... 2011-192304

(51) Int. Cl.
*F27B 9/06* (2006.01)
*F27B 9/24* (2006.01)
(Continued)

(52) U.S. Cl.
CPC ..... *F27B 9/068* (2013.01); *F27B 9/08* (2013.01); *F27B 9/10* (2013.01); *F27B 9/24* (2013.01);
(Continued)

(58) Field of Classification Search
USPC ..... 432/147, 227, 126, 175
See application file for complete search history.

(56) References Cited

U.S. PATENT DOCUMENTS 2,045,773 A 6/1936 Havey ..... 263/6
3,143,515 A * 8/1964 Hurley ..... C08J 11/12 521/49
(Continued)

FOREIGN PATENT DOCUMENTS

CN 1346960 A 5/2002
CN 101978030 A 2/2011
(Continued)

OTHER PUBLICATIONS

JP2007212082A—machine translation.*
(Continued)

*Primary Examiner* — Nathaniel Herzfeld
(74) *Attorney, Agent, or Firm* — Ostrolenk Faber LLP

(57) ABSTRACT

A continuous heating furnace (200) includes a conveyance body (210) stretched in an endless shape and configured to convey a burning target, a furnace main body (212) partially or entirely surrounding the conveyance body to form a burning space, and a roller (214) configured to support a portion of the conveyance body in the furnace main body. The continuous heating furnace (200) further includes one or more closed gas heaters having an introduction hole configured to introduce a fuel gas into a heater main body, a combustion chamber in which the fuel gas is combusted, a discharge section to which an exhaust gas is guided, a radiation surface heated by the exhaust gas flowing through the discharge section or combustion in the combustion chamber and configured to transfer radiant heat to a burning target, and an exhaust hole configured to exhaust the exhaust gas that heats the radiation surface to the outside of the heater main body, and disposed in the furnace main body,
(Continued)

and an exhaust pipe (216) in communication with the exhaust hole of the closed gas heater and through which the exhaust gas is guided. In addition, the exhaust pipe enables heat exchange between the exhaust gas flowing through the exhaust pipe and the roller.

3 Claims, 16 Drawing Sheets

(51) Int. Cl.

| | |
|---|---|
| ***F27B 9/08*** | (2006.01) |
| ***F27B 9/10*** | (2006.01) |
| ***F27B 9/30*** | (2006.01) |
| ***F27D 3/02*** | (2006.01) |
| ***F27D 17/00*** | (2006.01) |
| ***F27D 99/00*** | (2010.01) |
| *F27B 9/36* | (2006.01) |

(52) U.S. Cl.
CPC ..... *F27B 9/3044* (2013.01); *F27D 3/026* (2013.01); *F27D 17/004* (2013.01); *F27D 99/0035* (2013.01); *F27B 2009/3623* (2013.01)

(56) References Cited

U.S. PATENT DOCUMENTS

| | | | | | |
|---|---|---|---|---|---|
| 3,216,489 | A * | 11/1965 | Norton | D21F 5/024 | 165/104.19 |
| 3,245,131 | A * | 4/1966 | Kimble | F27B 9/142 | 193/12 |
| 4,217,090 | A * | 8/1980 | Whike | F27B 9/36 | 432/21 |
| 4,383,823 | A * | 5/1983 | Williams | A21B 1/48 | 432/148 |
| 4,493,308 | A * | 1/1985 | Hurley | A47J 37/06 | 122/17.2 |
| 4,553,526 | A * | 11/1985 | von Conta | F24B 1/026 | 110/213 |
| 4,951,648 | A | 8/1990 | Shukla et al. | 126/21 | |
| 5,022,911 | A * | 6/1991 | Balestra | C03B 29/08 | 126/39 J |
| 5,193,996 | A * | 3/1993 | Mullen | D01F 9/14 | 34/640 |
| 5,766,382 | A * | 6/1998 | Hertzog | C21D 9/0018 | 148/656 |
| 5,840,101 | A * | 11/1998 | Keller | F26B 13/30 | 95/258 |
| 5,906,485 | A * | 5/1999 | Groff | A21B 1/48 | 432/121 |
| 5,993,202 | A * | 11/1999 | Yamazaki et al. | 432/128 | |
| 2002/0045144 | A1 | 4/2002 | Mori et al. | | |
| 2003/0027095 | A1* | 2/2003 | Sugimoto et al. | 432/37 | |
| 2003/0051647 | A1* | 3/2003 | Sugano | C10B 49/02 | 110/224 |
| 2003/0221647 | A1* | 12/2003 | Kobayashi et al. | 123/90.17 | |
| 2007/0220921 | A1* | 9/2007 | Zhao | 65/335 | |
| 2011/0013892 | A1* | 1/2011 | Ragay et al. | 392/411 | |
| 2013/0192591 | A1* | 8/2013 | Satoh et al. | 126/92 AC | |
| 2013/0216965 | A1* | 8/2013 | Satoh | 431/328 | |
| 2014/0106288 | A1* | 4/2014 | Satoh et al. | 432/147 | |
| 2014/0116423 | A1* | 5/2014 | Satoh et al. | 126/92 AC | |
| 2014/0170582 | A1* | 6/2014 | Satoh et al. | 432/147 | |

FOREIGN PATENT DOCUMENTS

| | | | |
|---|---|---|---|
| DE | 2115399 | A1 | 3/1972 |
| DE | 102011006171 | A1 | 9/2012 |
| EP | 2 618 053 | A1 | 7/2013 |
| JP | 59-086888 | | 5/1984 |
| JP | A-06-018178 | | 1/1994 |
| JP | A-08-313161 | | 11/1996 |
| JP | 2001-116463 | | 4/2001 |
| JP | 2003-021462 | | 1/2003 |
| JP | 2007212082 | A * | 8/2007 |
| JP | 2008-116072 | | 5/2008 |
| TW | 500910 | B | 9/2002 |

OTHER PUBLICATIONS

Office Action dated Feb. 26, 2015 in corresponding Taiwan Patent Application No. 101131981 with English language translation of Search Report (6 pages).

International Search Report and Written Opinion dated Nov. 20, 2012 in corresponding PCT International Application No. PCT/JP2012/071789.

Office Action dated Jan. 19, 2015 in corresponding Chinese Patent Application No. 201280041982.8 with English language translation of Search Report (7 pages).

Extended European Search Report dated Jul. 17, 2015 for corresponding European Application No. 12829418.8.

* cited by examiner

CONTINUOUS HEATING FURNACE

This application is a continuation application based on a PCT Patent Application No. PCT/JP2012/071789, filed Aug. 29, 2012, whose priority is claimed on Japanese Patent Application No. 2011-192304, filed Sep. 5, 2011. The contents of both the PCT application and the Japanese Patent Application are incorporated herein by reference.

TECHNICAL FIELD

The present invention relates to a continuous heating furnace configured to heat sequentially conveyed burning targets.

BACKGROUND ART

In the related art, a continuous heating furnace including a plurality of gas heaters used to heat a radiator with combustion heat generated by combusting a fuel gas and heating an industrial material, food, or the like, with radiant heat from a radiation surface of the radiator has been widely distributed.

The continuous heating furnace drives a conveyance body such as an endless belt or the like and burns a burning target while conveying the burning target in a heating space in a furnace main body. A portion of the conveyance body is cooled at the outside of the furnace main body (a heating space), and heat in the heating space is radiated to repeat a cycle of absorbing heat in the furnace main body. This causes a decrease in thermal efficiency of the continuous heating furnace. Here, a configuration of the heating furnace in which a conveyance portion of a conveyance body conveyed from a downstream side to an upstream side in a conveyance direction is surrounded by a thermal insulation wall, air in the heating space flows into a space surrounded by the thermal insulation wall, and a decrease in temperature of the conveyance body of the conveyance portion is suppressed to improve thermal efficiency is disclosed (for example, Patent Document 1).

DOCUMENT OF RELATED ART

Patent Document

[Patent Document 1] Japanese Unexamined Patent Application, First Publication No. 2001-116463

SUMMARY OF INVENTION

Technical Problem

The conveyance body is supported by a roller. Heat of a portion of the roller in the vicinity of the gas heater is transferred to a portion spaced apart from the gas heater. For this reason, a temperature of the roller in the vicinity of the burning target is decreased, and thermal efficiency is lowered. In addition, in particular, in a burning target in which bending should be suppressed (for example, a rice cracker or the like), since upper and lower sides of the burning target are surrounded by a net and the outside thereof is sandwiched and pressed by the rollers, the number of rollers is increased. For this reason, the thermal efficiency is further reduced.

In consideration of the above-mentioned problems, the present invention is directed to provide a continuous heating furnace capable of suppressing a decrease in temperature of a roller that supports a conveyance body and improving thermal efficiency.

Solution to Problem

A continuous heating furnace according to a first aspect of the present invention includes a conveyance body stretched in an endless shape and configured to convey a burning target; and a furnace main body partially or entirely surrounding the conveyance body to form a burning space. In addition, the continuous heating furnace includes a roller configured to support a portion of the conveyance body in the furnace main body; one or more closed gas heaters having an introduction hole configured to introduce a fuel gas into a heater main body, a combustion chamber in which the fuel gas introduced from the introduction hole is combusted, a discharge section to which an exhaust gas generated by combustion in the combustion chamber is guided, a radiation surface heated by the exhaust gas flowing through the discharge section or combustion in the combustion chamber and configured to transfer radiant heat to the burning target, and an exhaust hole configured to exhaust the exhaust gas that heats the radiation surface to the outside of the heater main body, and disposed in the furnace main body; and an exhaust pipe in communication with the exhaust hole of the closed gas heater and through which the exhaust gas is guided. Further, the exhaust pipe is configured to enable heat exchange between the exhaust gas flowing through the exhaust pipe and the roller.

In the continuous heating furnace according to a second aspect of the present invention, in the first aspect, the roller is hollow, and the exhaust gas flowing through the exhaust pipe is guided to the roller.

In the continuous heating furnace according to a third aspect of the present invention, in the first or second aspect, the exhaust pipe is configured to enable heat exchange with a portion of the roller protruding in a direction perpendicular to a conveyance direction of the burning target rather than with the conveyance body.

Effects of Invention

According to the present invention, a decrease in temperature of the roller that supports the conveyance body can be suppressed, and thermal efficiency can be improved.

DESCRIPTION OF EMBODIMENTS

Figure 1:
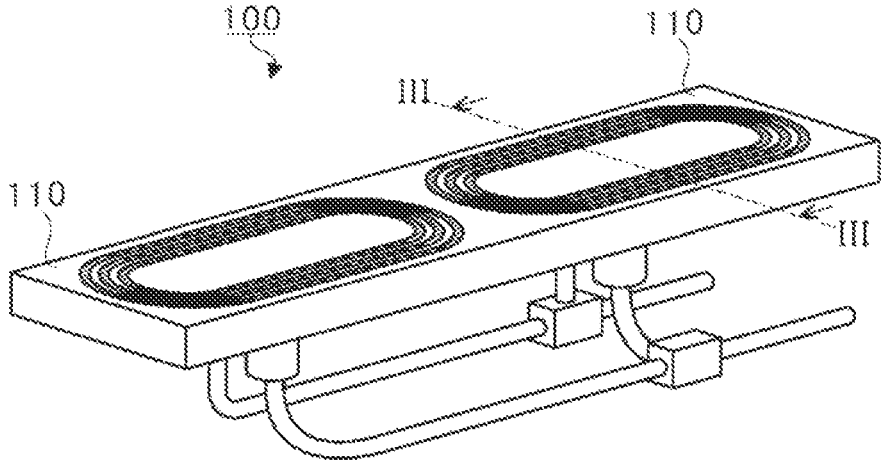
FIG. 1 is a perspective view showing an appearance example of a closed gas heater system according to a first embodiment of the present invention.

Exemplary embodiments of the present invention will be described in detail with reference to the accompanying drawings. Dimensions, materials, other specific numerical values, or the like, specified in the embodiments are merely exemplary examples for the convenience of understanding of the present invention and not limiting to the present invention unless the context clearly indicates otherwise. In addition, in the embodiments, elements having substantially the same functions and configurations are designated by the same reference numerals and overlapping descriptions will not be repeated.

A continuous heating furnace of a first embodiment includes a plurality of closed gas heater systems installed in the furnace. First, the closed gas heater system will be described, and then a configuration of the continuous heating furnace will be described.

First Embodiment: Closed Gas Heater System 100

FIG. 1 is a perspective view showing an appearance example of a closed gas heater system 100 of a first embodiment. The closed gas heater system 100 according to the embodiment is a premixing type in which natural gas or the like and air as an oxidant gas for combustion are mixed before supply into a main body container. The closed gas heater system 100 is not limited thereto but may be a diffusion type in which diffusion combustion is performed.

As shown in FIG. 1, the closed gas heater system 100 includes a plurality of (in an example shown in FIG. 1, two) closed gas heaters 110, which are connected in parallel, and receives a mixed gas (hereinafter referred to as "a fuel gas") of natural gas or the like and air, so that the fuel gas is combusted in each of the closed gas heaters 110 to perform heating. In the closed gas heater system 100, an exhaust gas generated by the combustion is collected.

Figure 2:
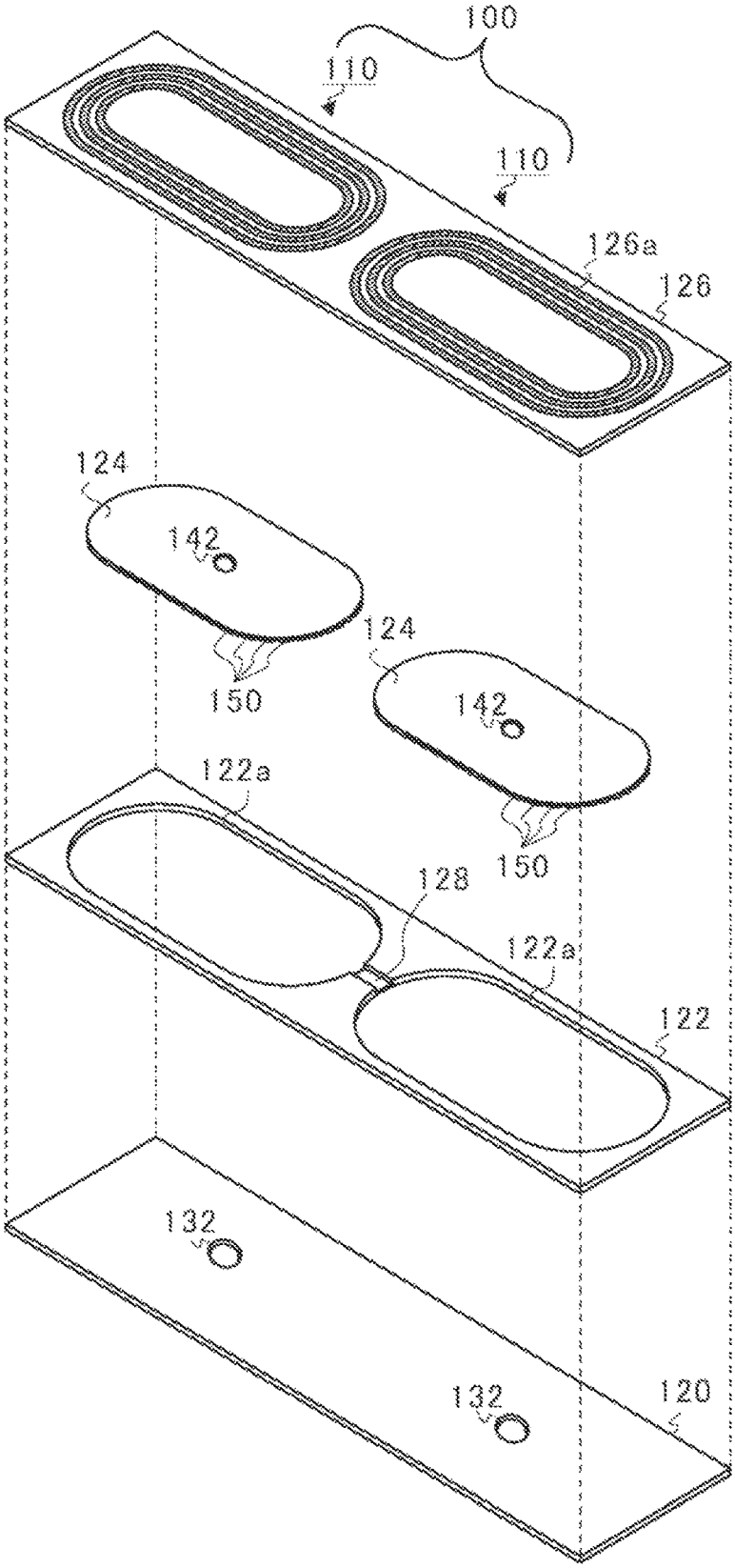
FIG. 2 is a view showing a structure of the closed gas heater system according to the first embodiment of the present invention.

FIG. 2 is view showing a structure of the closed gas heater system 100 according to the first embodiment. As shown in FIG. 2, the closed gas heater system 100 includes a disposition plate 120, an outer circumferential wall 122, a partition plate 124 and a heating plate 126.

The disposition plate 120 is a thin plate-shaped member formed of a material having a thermal resistance and oxidation resistance, for example, stainless steel (SUS: stainless used steel) or the like.

The outer circumferential wall 122 is constituted by thin plate-shaped members having an outer circumferential surface, which is flush with an outer circumferential surface of the disposition plate 120, and stacked on the disposition plate 120. The outer circumferential wall 122 includes an inner circumference having a track shape (a shape constituted by two substantially parallel lines and two arcs (semi circles) connecting the two lines), and two through-holes 122*a* passing therethrough in a thickness direction (a stacking direction of the outer circumferential wall 122 and the disposition plate 120).

Like the disposition plate 120, the partition plate 124 is formed of a material having high thermal resistance and oxidation resistance (for example, stainless steel), a material having high thermal conductivity (for example, brass), or the like. The partition plate 124 is constituted by a thin plate member, an exterior of which follows an inner circumferential surface of the through-hole 122*a* of the outer circumferential wall 122, that is disposed inside the outer circumferential wall 122 and parallel to the disposition plate 120. In addition, the outer circumferential surface of the partition plate 124 is spaced a certain interval from the inner circumferential surface of the through-hole 122*a* in a state in which the partition plate 124 is accommodated in the through-hole 122*a* of the outer circumferential wall 122.

Like the disposition plate 120, the heating plate 126 is constituted by a thin plate-shaped member formed of a material having high thermal resistance and oxidation resistance (for example, stainless steel), a material having high thermal conductivity (for example, brass), or the like. A concavo-convex section 126*a* in which concave and convex portions are formed is formed in the heating plate 126. According to the above-mentioned configuration, a difference in variation amount of thermal expansion is absorbed at the concavo-convex section 126*a* by a temperature difference between the heating plate 126 and the disposition plate 120 and a difference in materials of the heating plate 126 and the disposition plate 120, and stress generated from a coupling portion or the like to the outer circumferential wall 122 is reduced. For this reason, as heating and cooling are repeated, thermal fatigue and high temperature creep can be suppressed. In addition, an area of a radiation surface (to be described below) of the heating plate 126 is increased. For this reason, radiant intensity can also be increased.

In addition, the disposition plate 120, the partition plate 124 and the heating plate 126 may be inclined to be opposite to each other when a void is formed therebetween. Further, thicknesses of the disposition plate 120, the partition plate 124 and the heating plate 126 are not limited, and the disposition plate 120 and the partition plate 124 may also have shapes with varying thicknesses.

The heating plate 126 has an appearance such that the outer circumferential surface is flush with outer circumferential surfaces of the disposition plate 120 and the outer circumferential wall 122, and is stacked on the outer circumferential wall 122 and the partition plate 124. Here, the heating plate 126 and the disposition plate 120 are disposed substantially in parallel (substantially in parallel to cause excessive enthalpy combustion in the embodiment).

A main body container of the closed gas heater system 100 is configured by closing upper and lower sides of the outer circumferential wall 122 with the heating plate 126 and the disposition plate 120. In addition, an area of upper and lower wall surfaces (outer surfaces of the heating plate 126 and the disposition plate 120) is larger than that of an outer circumferential surface (an outer surface of the outer circumferential wall 122). That is, the upper and lower wall surfaces occupy most of the outer surface of the main body container.

In addition, the closed gas heater system 100 is configured by connecting the two closed gas heaters 110 in parallel. A fire shift section 128 in communication with a closed space in the connected closed gas heaters 110 is formed at the connecting portion between the closed gas heaters 110. However, even when the closed space is used in a gas, the closed space may not be perfectly closed. In the closed gas heater system 100 of the embodiment, for example, a flame is spread to the closed gas heaters 110 connected through the fire shift section 128 to perform ignition by one ignition by an ignition apparatus such as an ignitor (not shown) or the like. As described above, while the two closed gas heaters 110 are installed at the closed gas heater system 100, the two closed gas heaters 110 also have the same configuration. For this reason, hereinafter, one of the closed gas heaters 110 will be described.

Figure 3A:
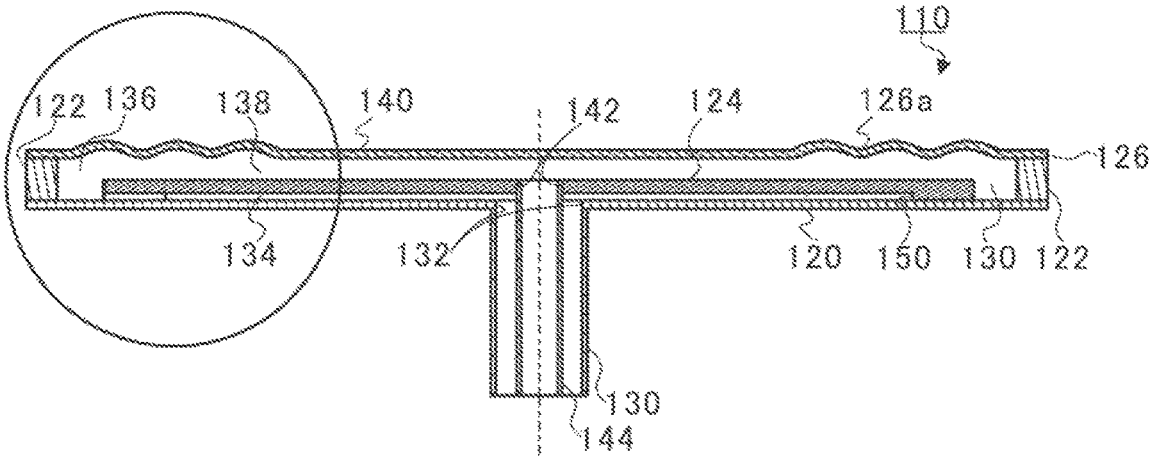
FIG. 3A is a cross-sectional view taken along line of FIG. 1.
Figure 3B:
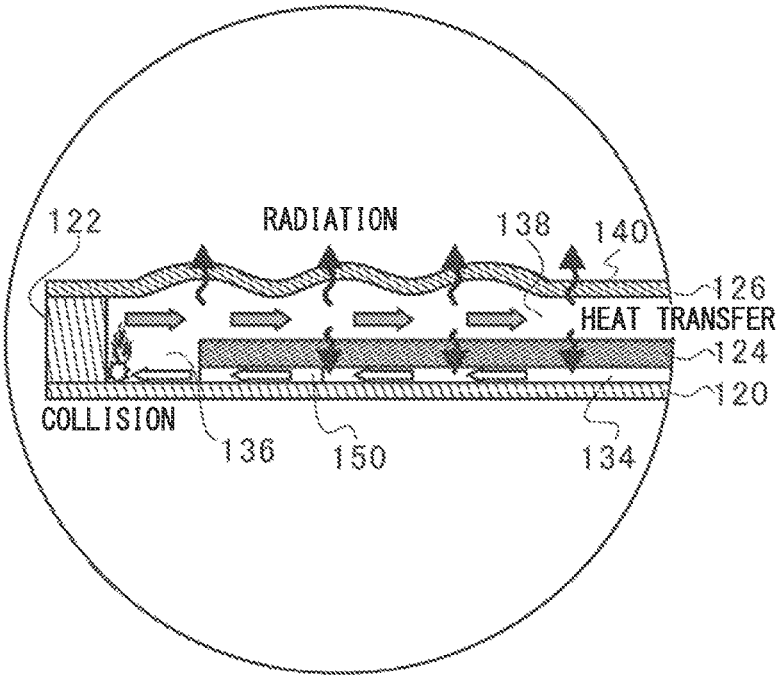
FIG. 3B is an enlarged view of a circular portion of FIG. 3A.

FIGS. 3A and 3B are cross-sectional views taken along line of FIG. 1. As shown in FIG. 3A, an introduction hole 132 passing through a central section of the closed gas heater 110 in the thickness direction is formed in the disposition plate 120. A first piping section 130 through which a fuel gas flows is connected to the introduction hole 132. The fuel gas is guided into the closed gas heater 110 via the introduction hole 132.

An introduction section 134 and a discharge section 138 are formed to overlap in the main body container in the thickness direction (a direction perpendicular to an opposite surface of the disposition plate 120 and the heating plate 126).

The introduction section 134, which is a space sandwiched between the disposition plate 120 and the partition plate 124, is disposed to continue from a combustion chamber 136, and radially guides the fuel gas introduced from the introduction hole 132 into the combustion chamber 136.

The combustion chamber 136 is disposed in a space surrounded by the outer circumferential wall 122, the heating plate 126 and the disposition plate 120. In addition, the combustion chamber 136 faces an outer circumferential end section of the partition plate 124 and is formed along the outer circumferential wall 122. In the combustion chamber 136, the fuel gas introduced from the introduction hole 132 via the introduction section 134 is combusted. According to the configuration in which the combustion chamber 136 is formed along the outer circumferential wall 122, a volume of the combustion chamber 136 can be sufficiently secured and a combustion rate can be reduced in comparison with a Swiss roll type. A firing apparatus (not shown) is installed at an arbitrary position of the combustion chamber 136.

The discharge section 138, which is a space sandwiched between the heating plate 126 and the partition plate 124, is disposed to continue from the combustion chamber 136, and collects the exhaust gas generated by combustion in the combustion chamber 136 to a central section of the closed gas heater 110.

In addition, the introduction section 134 and the discharge section 138 are formed in the main body container to overlap in the thickness direction. Accordingly, heat of the exhaust gas can be transferred to the fuel gas through the partition plate 124 and the fuel gas can be preheated.

A radiation surface 140, which is an outer surface of the heating plate 126, is heated by the exhaust gas passing through the discharge section 138 or combustion in the combustion chamber 136 and transfers the radiant heat to the burning target.

An exhaust hole 142 passing through the central section of the closed gas heater 110 in the thickness direction is formed in the partition plate 124. A second piping section 144 is fitted into an inner circumferential portion of the exhaust hole 142. The exhaust gas that has heated the radiation surface 140 is exhausted to the outside of the closed gas heater 110 via the exhaust hole 142.

The second piping section 144 is disposed in the first piping section 130. That is, a dual pipe is constituted by the first piping section 130 and the second piping section 144. In addition, the second piping section 144 has a function of transferring heat of the exhaust gas to the fuel gas flowing through the first piping section 130.

The disposition plate 120 is fixed to a distal end of the first piping section 130, and the partition plate 124 is fixed to a distal end of the second piping section 144 protruding farther than the first piping section 130. The disposition plate 120 and the partition plate 124 are spaced apart from each other by a difference between the distal end of the first piping section 130 and the distal end of the second piping section 144.

In addition, in the embodiment, the second piping section 144 is disposed in the first piping section 130. The embodiment is not limited to the above-mentioned case, but the first piping section 130 and the second piping section 144 may be inserted into the introduction section 134 and the discharge section 138 from the heating plate 126 side, and the first piping section 130 may be disposed in the second piping section 144.

Next, flows of the fuel gas and the exhaust gas will be described in detail. In FIG. 3B showing an enlarged view of a circular portion of FIG. 3A, a white arrow is a flow of the fuel gas, a gray arrow is a flow of the exhaust gas, and a black arrow is movement of heat. When the fuel gas is supplied into the first piping section 130, the fuel gas flows from the introduction hole 132 into the introduction section 134 and flows toward the combustion chamber 136 while spreading radially in a horizontal direction. The fuel gas collides with the outer circumferential wall 122 in the combustion chamber 136 to be decreased in flow speed, is combusted by the ignited frame, and then becomes a high temperature exhaust gas. The exhaust gas flows through the discharge section 138 to transfer the heat to the radiation surface 140 of the heating plate 126, and then is discharged from the second piping section 144 to an exhaust heat transfer section (to be described below) through the exhaust hole 142.

The partition plate 124 is formed of a material that enables relatively easy thermal conduction. The heat of the exhaust gas passing through the discharge section 138 is transferred to the fuel gas passing through the introduction section 134 via the partition plate 124. The exhaust gas flowing through the discharge section 138 and the fuel gas flowing through the introduction section 134 are opposite flows (counter flows) that sandwich the partition plate 124. For this reason, the fuel gas can be efficiently preheated by the heat of the exhaust gas, and high thermal efficiency can be obtained. As the fuel gas is preheated and then combusted (excessive enthalpy combustion), combustion of the fuel gas is stabilized, and a concentration of CO (carbon monoxide) generated due to imperfect combustion can be suppressed to an extremely low concentration.

Further, in order to prevent backfire, a protrusion 150 is formed at a boundary between the introduction section 134 and the combustion chamber 136. A flame (propagation of a combustion reaction) from the combustion chamber 136 to the introduction section 134 is prevented by the protrusion 150. The protrusion 150 will be described with reference to FIGS. 4A and 4B.

Figure 4A:
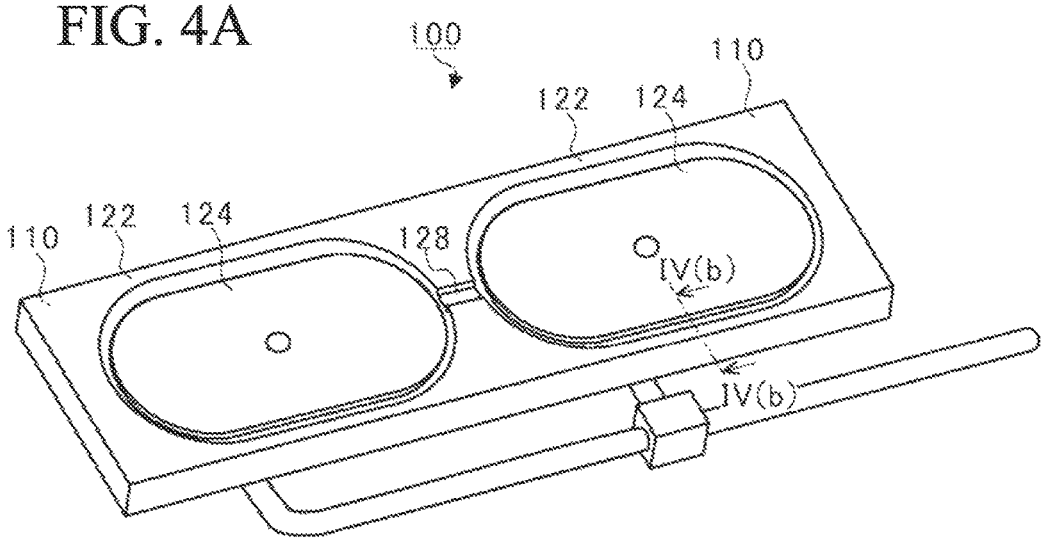
FIG. 4A is a perspective view of the closed gas heater system showing a plurality of protrusions.
Figure 4B:
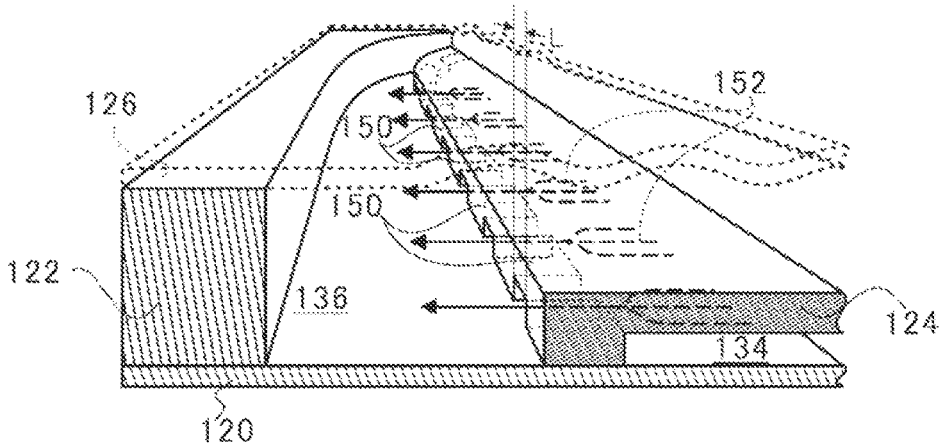
FIG. 4B is a cross-sectional view taken along line IV(b)-IV(b) of FIG. 4A, showing the plurality of protrusions.

FIGS. 4A and 4B are views showing the plurality of protrusions 150. FIG. 4A is a perspective view of the closed gas heater system 100 except for the heating plate 126, and FIG. 4B is a cross-sectional view taken along line IV(b)-IV (b) of FIG. 4A when seen in a direction of an arrow. In FIG. 4B, in order to easily understand a structure of the plurality of protrusions 150, portions of the heating plate 126 and the protrusion 150 hidden by the partition plate 124 are shown by broken lines. In addition, an arrow 152 shows a direction of a flow of the fuel gas. The introduction section 134 has a flow path cross-section narrowed by the plurality of protrusions 150 installed at the partition plate 124. The fuel gas flows into the combustion chamber 136 through a void between the neighboring protrusions 150 in the introduction section 134 as shown in FIGS. 3B and 4B.

As described above, according to the closed gas heater system 100 of the embodiment, since the fuel gas is preheated by the heat of the exhaust gas, high thermal efficiency can be obtained and the exhaust gas is not diffused. Accordingly, the heat of the exhaust gas can be effectively used in a continuous heating furnace 200 (to be described below).

Next, the continuous heating furnace 200 in which the plurality of closed gas heater systems 100 are disposed will be described.

Figure 5A:
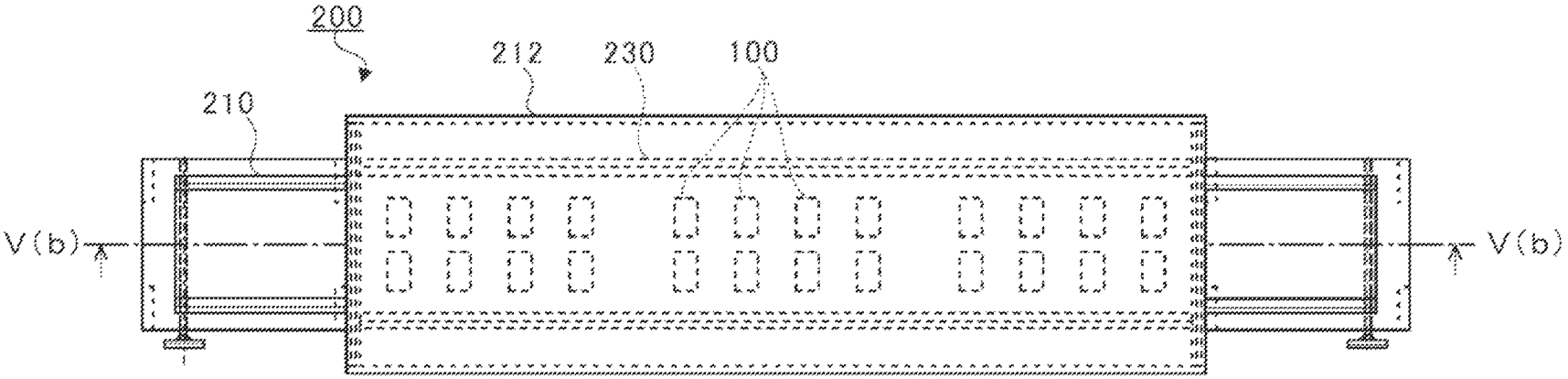
FIG. 5A is a plan view of a continuous heating furnace according to the first embodiment of the present invention, showing an outline of the continuous heating furnace.
Figure 5B:
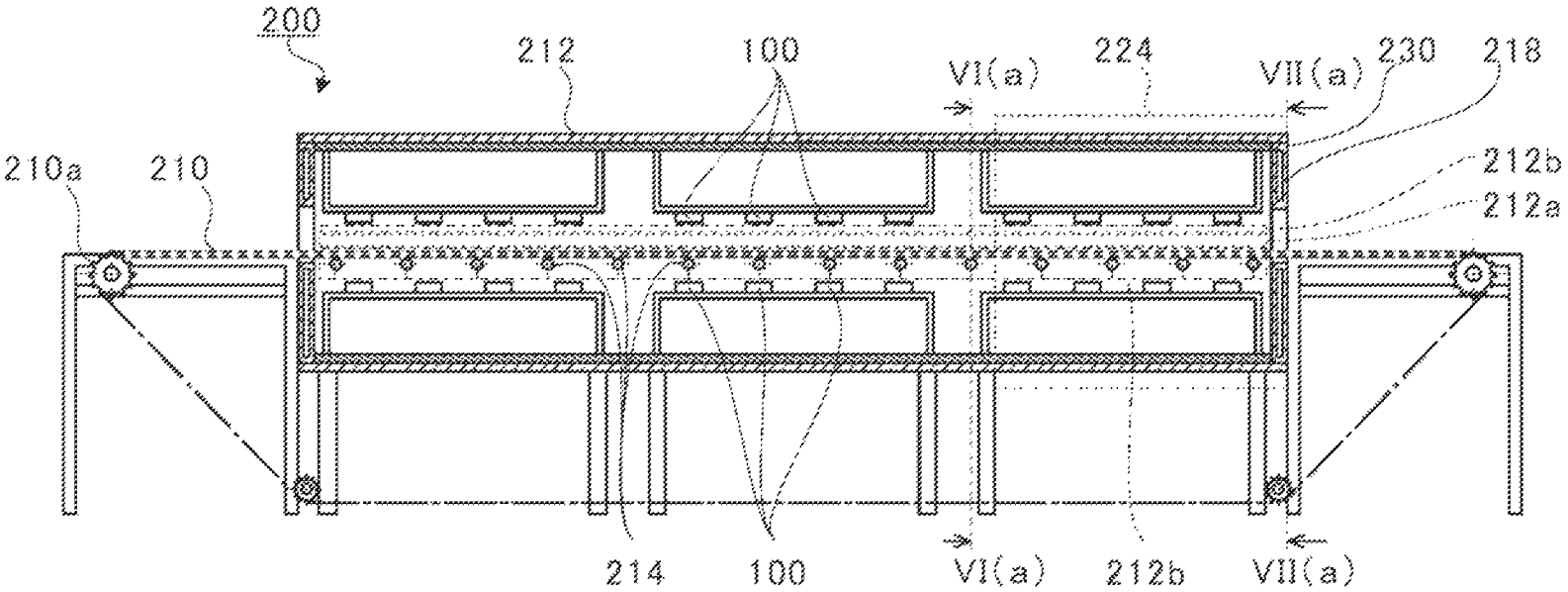
FIG. 5B is a cross-sectional view taken along line V(b)-V(b) of FIG. 5A showing an outline of the continuous heating furnace according to the first embodiment of the present invention.

FIGS. 5A and 5B are views showing an outline of the continuous heating furnace 200 according to the first embodiment. In particular, FIG. 5A is a plan view of the continuous heating furnace 200, and FIG. 5B is a cross-sectional view taken along line V(b)-V(b) of FIG. 5A.

A conveyance body 210 is constituted by a conveyor, for example, a belt or the like, stretched and supported by a roller 214, and rotated by a gear 210*a* receiving power of a motor (not shown) to convey the burning target. The burning target is disposed on the conveyance body 210. The burning target is hung and supported by, for example, a hoist mechanism (not shown) installed at the conveyance body 210. In addition, in the embodiment, in a furnace main body 212, the space in which the burning target is disposed and through which the burning target passes upon conveyance is referred to as a target space 212*a*.

The furnace main body 212 forms a burning space partially or entirely surrounding the conveyance body 210. That is, the furnace main body 212 also surrounds the target space 212*a*.

The roller 214 supports a portion of the conveyance body 210 in the furnace main body 212 from a lower side in a vertical direction. In addition, in order to suppress deflection of the burning target, when the conveyance body is constituted by a pair of nets that sandwich upper and lower sides of the burning target, the roller 214 may be installed at the outside of the pair of nets.

The plurality of closed gas heater systems 100 are disposed in the furnace main body 212. In the embodiment, the plurality of closed gas heater systems 100 are disposed in the furnace main body 212 at upper and lower sides in the vertical direction of the conveyance body 210.

Figure 6A:
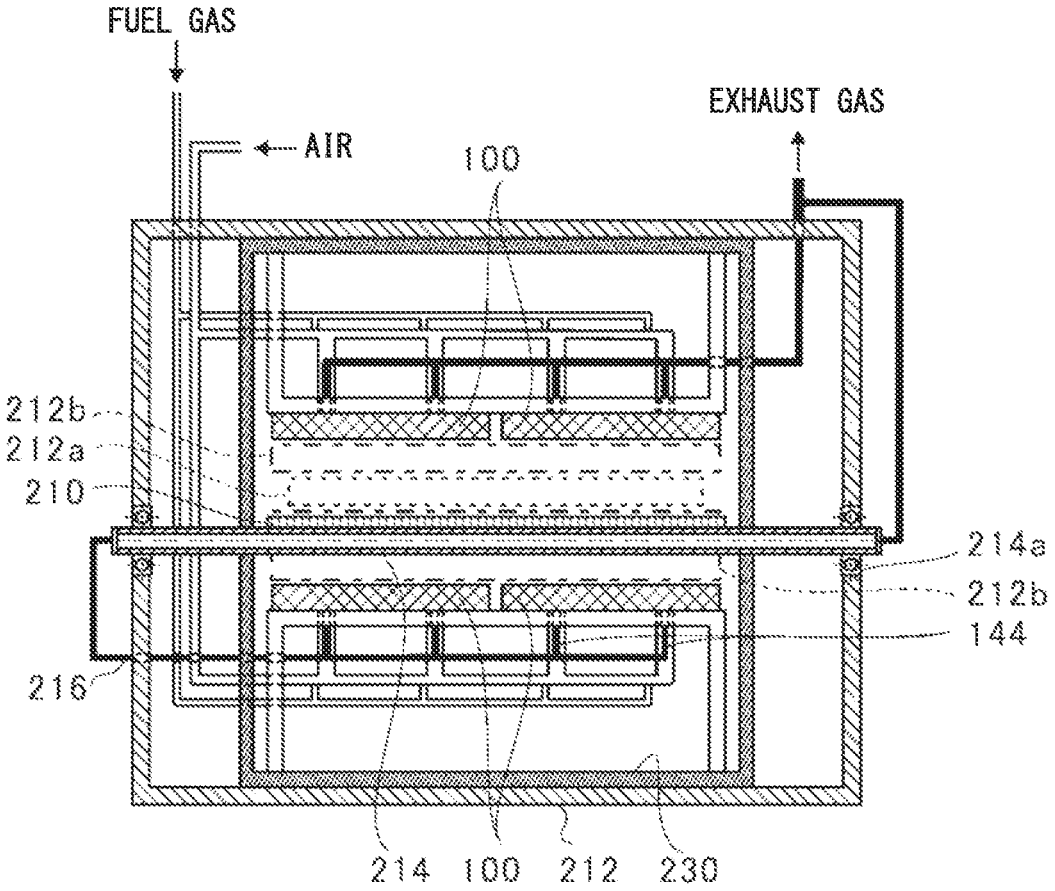
FIG. 6A is a cross-sectional view taken along line VI(a)-VI(a) of FIG. 5B, showing heat exchange of the roller according to the first embodiment of the present invention.
Figure 6B:
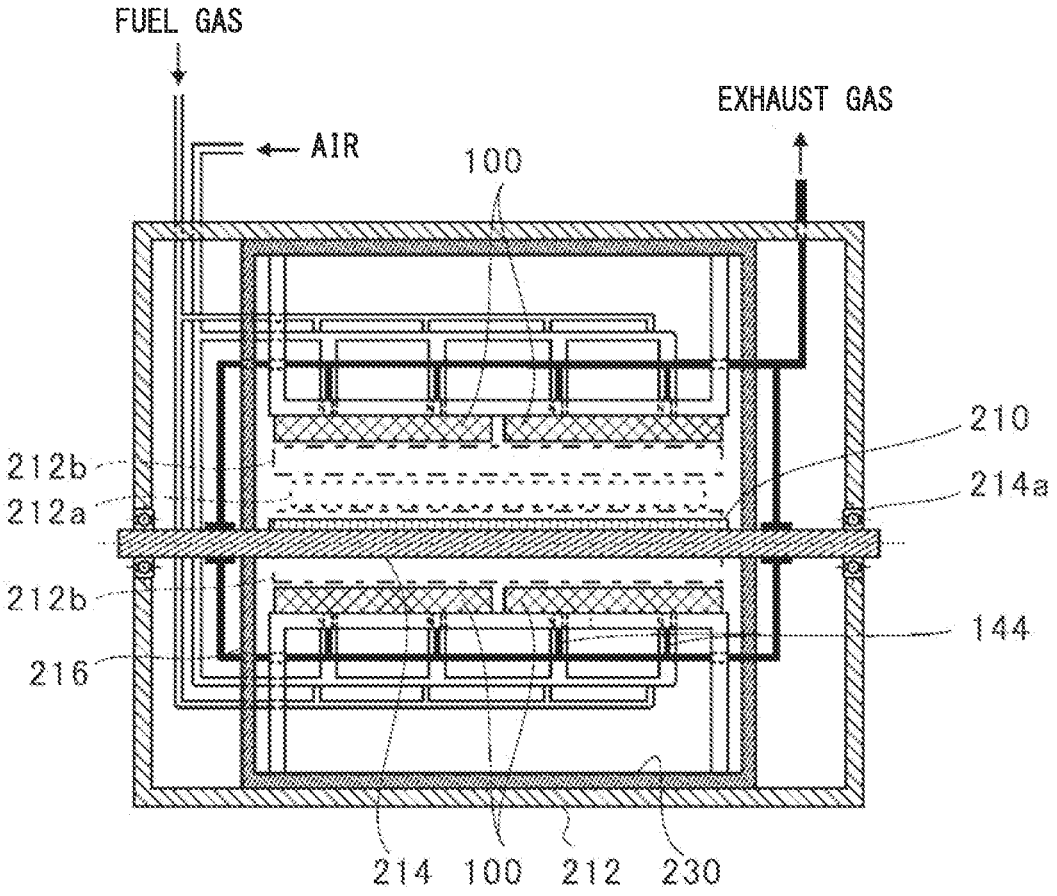
FIG. 6B is a view showing heat exchange of the roller according to the first embodiment of the present invention.

FIGS. 6A and 6B are views showing heat exchange of the roller 214 according to the first embodiment. FIG. 6A is a cross-sectional view taken along line VI(a)-VI(a) of FIG. 5B. For the convenience of understanding of a structure of the roller 214, a description of the insulated wall and the insulated pipe (to be described below) will be omitted. In addition, in the following drawings, a flow path of the exhaust gas (a space through which the exhaust gas flows) is shown in black, and the closed gas heater system 100 is cross-hatched.

As shown in FIG. 6A, an end section of the roller 214 passes through the wall surface of the furnace main body 212 to be exposed to the outside of the furnace main body 212, and is rotatably supported by a bearing 214*a* installed at a penetration portion of the wall surface.

An exhaust pipe 216 comes in communication with the second piping section 144 of the closed gas heater system 100 to guide the exhaust gas. A portion of a pipe extending from the closed gas heater system 100 at which the pipe is bent is referred to as the second piping section 144, and a pipe to which the plurality of second piping sections 144 are connected to a downstream side by the portion at which the pipe is bent is referred to as the exhaust pipe 216

The exhaust pipe 216 has a configuration that enables heat exchange between the exhaust gas flowing through the exhaust pipe 216 and the roller 214. Specifically, as shown in FIG. 6A, the roller 214 is hollow, and the exhaust pipe 216 is connected to an end section of the roller 214 outside the furnace main body 212. In addition, the exhaust gas flowing through the exhaust pipe 216 is guided into the roller 214.

The entire roller 214 can be warmed by the configuration in which the exhaust gas flows through the roller 214. In addition, absorption of the heat into the furnace main body 212 can be suppressed at any position of the roller 214, radiation to the outside of the furnace main body 212 through the roller 214 can be suppressed, and a decrease in temperature in the furnace main body 212 can be suppressed.

In addition, the roller 214 may be constituted by, for example, a shaft core and a tubular rotating body through which the shaft core passes, and the rotating body may be rotatably supported with respect to the shaft core fixed to the furnace main body 212. In this case, when the shaft core is hollow and the exhaust gas passing through the exhaust pipe 216 is guided into the shaft core, the structure can be simplified.

In addition, the exhaust pipe 216 may have a configuration that enables heat exchange with a portion of the roller 214 protruding in a direction perpendicular to the conveyance direction of the burning target more than the conveyance body 210 in the furnace main body 212. In an example shown in FIG. 6B, the exhaust pipe 216 surrounds and comes in partial contact with the portion protruding in the direction perpendicular to the conveyance direction of the burning target more than the conveyance body 210 to enable heat exchange with the roller 214, and extends in a vertical direction as it is.

According to a configuration in which the portion of the roller 214 protruding from the conveyance body 210 to be spaced apart from the closed gas heater system 100 is warmed with the heat of the exhaust gas, a mechanism configured to suppress a decrease in temperature of the roller 214 in the vicinity of the target space 212*a* can be realized as a simple configuration. As a result, manufacturing cost can be controlled.

As described above, in the continuous heating furnace 200 of the embodiment, the closed gas heater system 100 is a closed structure. Accordingly, the exhaust gas is guided to the exhaust pipe 216 at a high temperature without diffusion thereof. For this reason, the temperature of the exhaust pipe 216 is higher than that of the roller 214, and the roller 214 can be securely warmed. Accordingly, a decrease in temperature of the roller 214 in the vicinity of the burning target can be suppressed. Further, since the continuous heating furnace 200 uses the exhaust heat of the exhaust gas in the heat exchange with the roller 214, a new heat source is unnecessary. Accordingly, a decrease in thermal efficiency of the entire heating processing can be prevented.

In addition, in the embodiment, while the configuration in which the end section of the roller 214 is exposed to the outside of the furnace main body 212 has been exemplified, the entire roller 214 may be accommodated in the furnace main body 212. Even in this case, the roller 214 is warmed by heat exchange between the exhaust gas passing through the exhaust pipe 216 and the roller 214. For this reason, in the roller 214, a decrease in temperature generated due to heat transfer from the vicinity of the target space 212*a* to the portion spaced apart from the closed gas heater system 100 (a decrease in temperature in the vicinity of the target space 212*a*) can be suppressed.

In addition, in the inside of the furnace main body 212 or the outside of the furnace main body 212, when the exhaust gas may be diffused, the exhaust gas passing through the exhaust pipe 216 may be directly blasted to the roller 214. Eventually, when the heat exchange between the exhaust gas guided to the exhaust pipe 216 and the roller 214 becomes possible, a new heat source is unnecessary. Accordingly, a decrease in thermal efficiency of the entire heating processing can be suppressed.

Next, the insulated wall, the insulated pipe, the heat insulating board and the heat insulating layer that can be used to keep the inside of the furnace main body 212 warm will be described with reference to FIGS. 7A to 12B. For the convenience of understanding of these structures, in FIGS. 7A to 12B, a description of the above-mentioned exhaust pipe 216 will be omitted.

Figure 7A:
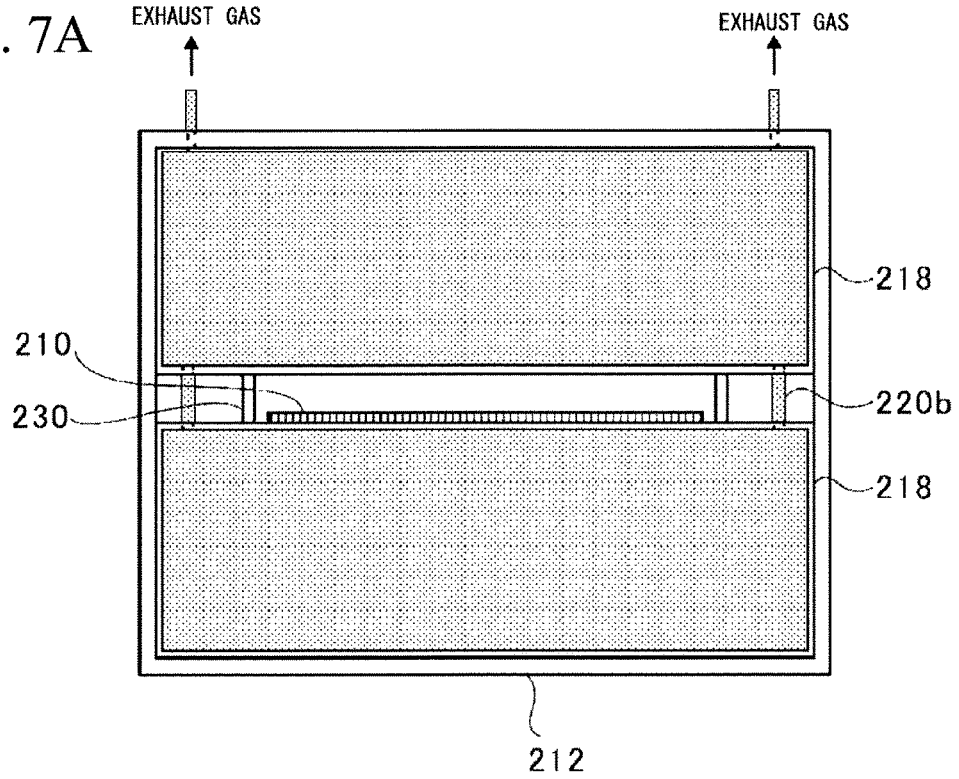
FIG. 7A is a cross-sectional view taken along VII(a)-VII (a) of FIG. 5B showing an insulated wall and an insulated pipe according to the first embodiment of the present invention.
Figure 7B:
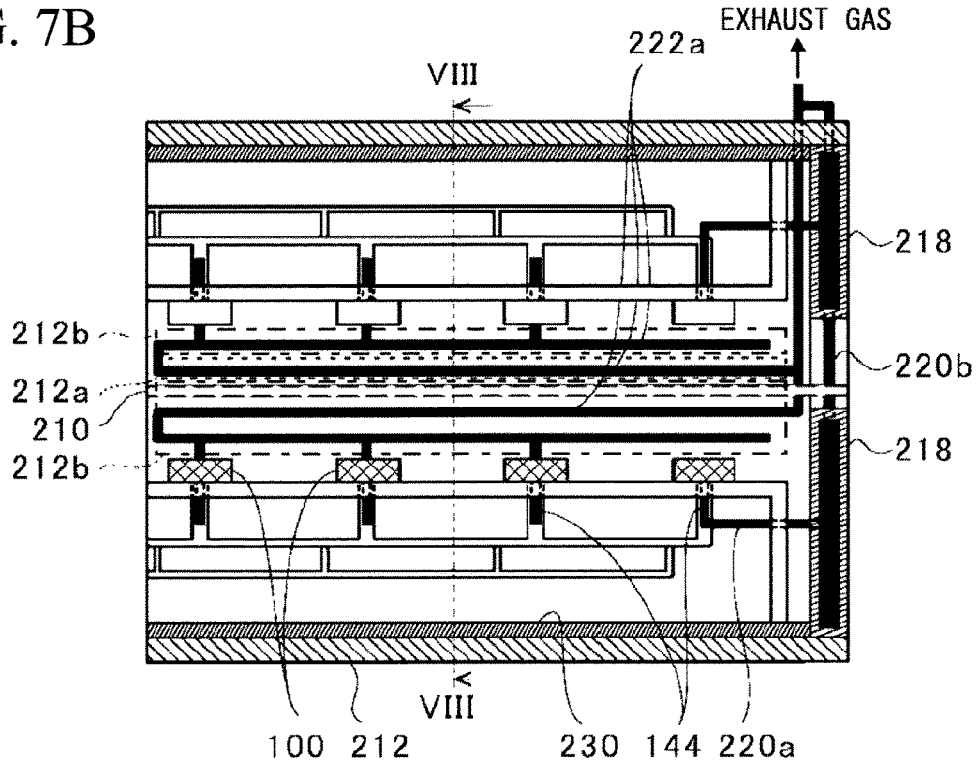
FIG. 7B is an enlarged view of a rectangular portion of FIG. 5B showing an insulated wall and an insulated pipe according to the first embodiment of the present invention.

FIGS. 7A and 7B are views showing an insulated wall 218 and an insulated pipe 222*a* of the first embodiment. FIG. 7A is a cross-sectional view taken along line VII(a)-VII(a) of FIG. 5B, and FIG. 7B is an enlarged view of a rectangular portion 224 of FIG. 5B.

As shown in FIGS. 7A and 7B, the insulated wall 218 is disposed at the end section in the conveyance direction of the continuous heating furnace 200 with a gap needed for conveyance of the burning target. The insulated wall 218 has a hollow inner space, and the exhaust gas discharged from the closed gas heater system 100 of the end section side (closest to the insulated wall 218) is guided via a communication pipe 220*a*. In addition, the upper and lower insulated walls 218 are in communication with each other via a communication pipe 220*b*. In FIGS. 7A and 7B, while the end section in rear in the conveyance direction is shown, the insulated wall 218 has the same configuration as the end section in front in the conveyance direction.

Figure 8:
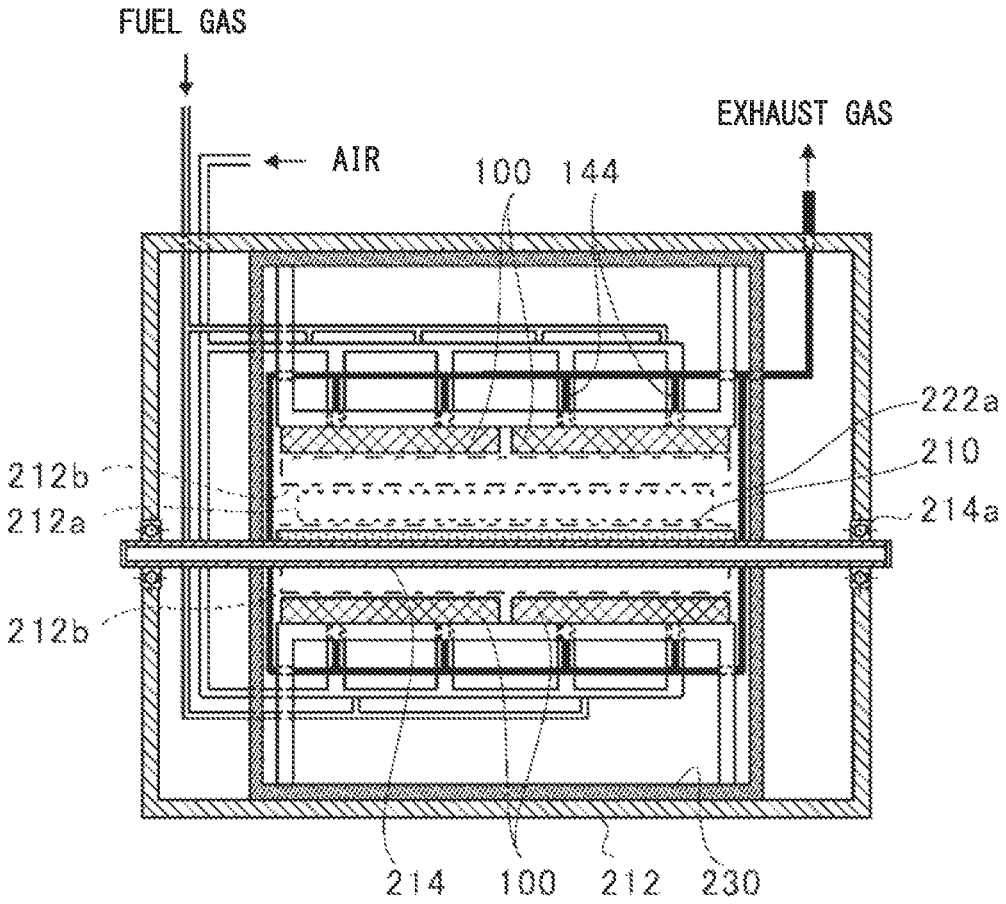
FIG. 8 is a cross-sectional view taken along line VIII-VIII of FIG. 7B.

FIG. 8 is a cross-sectional view taken along line VIII-VIII of FIG. 7B. The exhaust gas exhausted from the closed gas heater system 100 is guided through the insulated pipe 222*a* shown in FIGS. 7B and 8. The insulated pipe 222*a* is in communication with the second piping section 144, and as shown in FIG. 8, goes around and moves to the outside of the closed gas heater system 100. As shown in FIGS. 7B and 8, the insulated pipe 222*a* extends and repeatedly turns in the conveyance direction along side surfaces of the target space 212*a* parallel to the conveyance direction and the vertical direction An insulating section 230 shown in FIG. 7B has thermal insulation, and partially or entirely surrounds a radiation space 212*b* and the insulated pipe 222*a*. As shown in FIG. 8, the radiation space 212*b* is formed between the burning target (not shown) disposed in the target space 212*a* and the closed gas heater systems 100 disposed at upper and lower sides in the vertical direction. The radiation space 212*b* is a space in which the radiant heat is transferred to the burning target.

According to the configuration including the insulating section 230, the continuous heating furnace 200 can suppress radiation from the wall surface of the furnace main body 212 and improve thermal efficiency.

As described above, in the continuous heating furnace 200, the plurality of closed gas heater systems 100 are disposed to be opposite to each other to sandwich the target space 212*a*. The insulated pipe 222*a* is disposed to be opposite to a direction perpendicular to the opposite direction of the closed gas heater system 100. In addition, the radiation space 212*b* is surrounded by the closed gas heater system 100 and the insulated pipe 222*a*.

According to the above-mentioned configuration, the continuous heating furnace 200 keeps the portion at which the closed gas heater system 100 is not disposed warm with the insulated pipe 222*a* while performing radiation heating using the closed gas heater system 100 to sandwich the burning target. For this reason, a decrease in the temperature of the target space 212*a* can be suppressed.

In the continuous heating furnace 200 of the first embodiment, the closed gas heater system 100 is a closed structure. Accordingly, the exhaust gas is guided to the insulated wall 218 or the insulated pipe 222*a* at a high temperature without spreading in the furnace or the like. The insulated pipe 222*a* is disposed between the target space 212*a* and the wall surface of the furnace main body 212 or the portion in the furnace main body 212 at which the temperature is relatively lower. Accordingly, the continuous heating furnace 200 uniformizes the temperature distribution in the furnace main body 212. In addition, since the exhaust heat of the exhaust gas is used, a new heat source is unnecessary. Accordingly, a decrease in thermal efficiency of the entire heating processing can be prevented.

Second Embodiment

Next, insulated pipes 222*b* and 222*c* according to a second embodiment will be described. In the second embodiment, only the insulated pipes 222*b* and 222*c* are different from the first embodiment. For this reason, description of the same configuration as of the first embodiment will be omitted and only the insulated pipes 222*b* and 222*c* will be described.

Figure 9A:
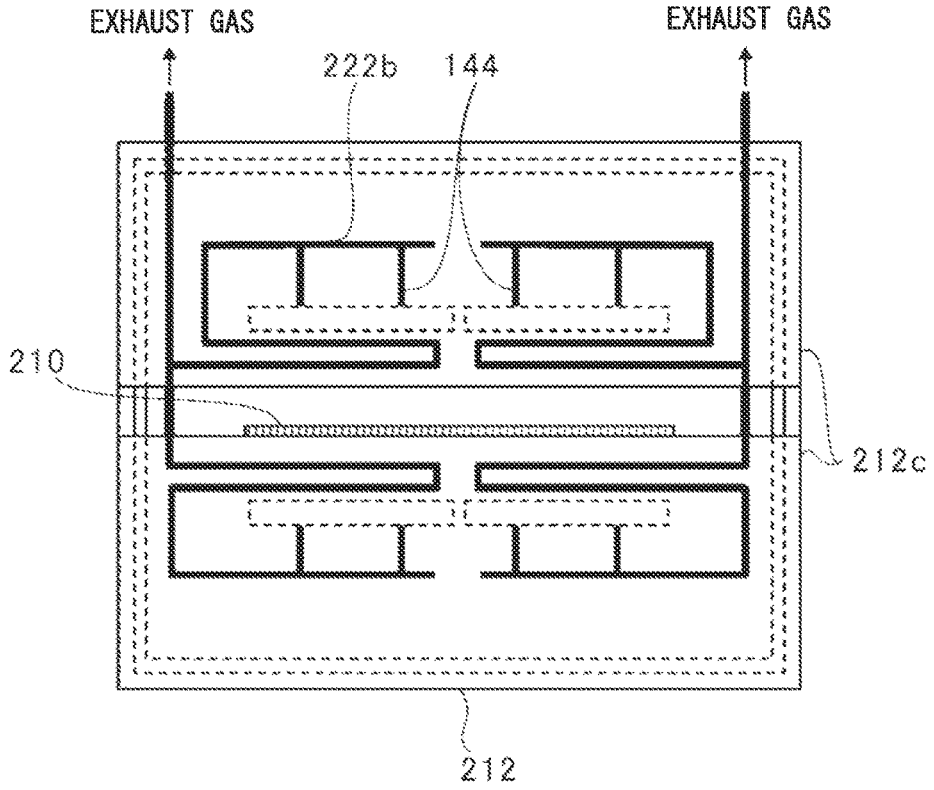
FIG. 9A is a view showing an insulated pipe according to a second embodiment of the present invention.
Figure 9B:
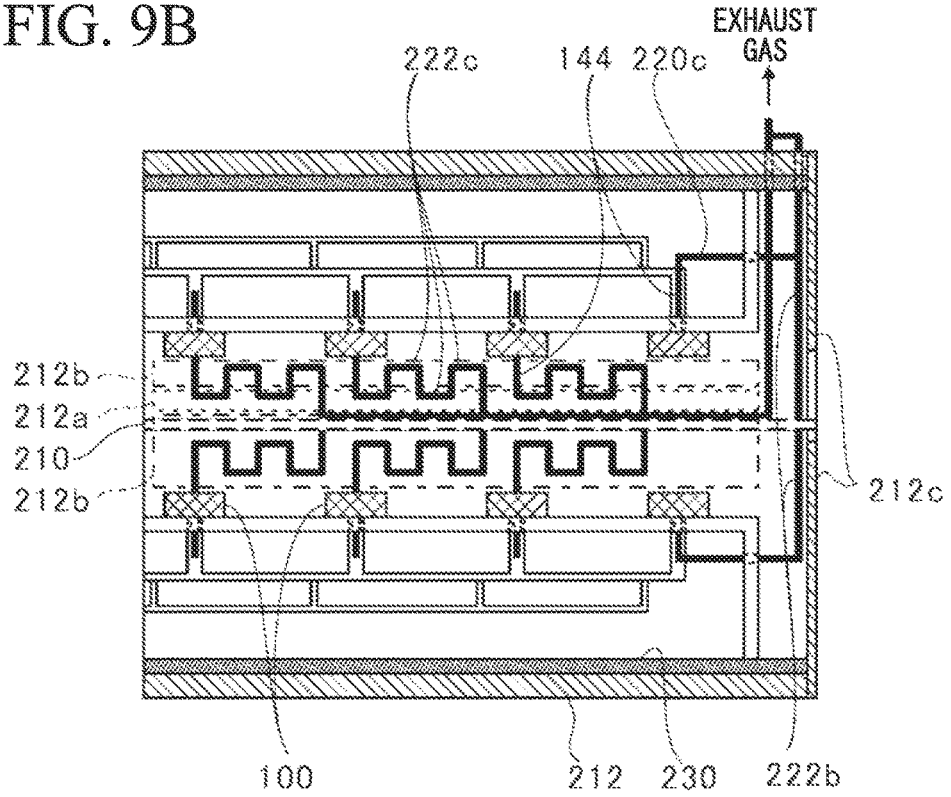
FIG. 9B is a view showing the insulated pipe according to the second embodiment of the present invention.

FIGS. 9A and 9B are views showing the insulated pipes 222*b* and 222*c* according to the second embodiment. FIG. 9A is a cross-sectional view of the same position as FIG. 7A, and FIG. 9B is an enlarged view of the same position as FIG. 7B. However, for the convenience of understanding of the position of the insulated pipe 222*b*, in FIG. 9A, it has been specified that the insulated pipe 222*b* hidden by a wall surface 212*c* at an inner side (a rear surface side) of the furnace main body 212 and shown by broken lines is shown in black. In addition, in FIG. 9B, a description of the roller 214 will be omitted here.

The insulated wall 218 configured to guide the exhaust gas thereinto is disposed at the end section in the conveyance direction of the continuous heating furnace 200 according to the first embodiment (see FIGS. 7A and 7B). In the second embodiment, as shown in FIGS. 9A and 9B, the end section in the conveyance direction of the continuous heating furnace 200 is covered by the simple wall surface 212*c*. The insulated pipe 222*b* is disposed along the wall surface 212*c* inside the furnace main body 212 in the wall surface 212*c*.

The exhaust gas discharged from the second piping section 144 of the closed gas heater system 100 close to the end section of the continuous heating furnace 200 (closest to the wall surface 212*c*) is guided to the insulated pipe 222*b* via a communication pipe 220*c*.

In addition, the insulated pipe 222*a* according to the first embodiment extends and repeatedly turns in the conveyance direction along side surfaces of the target space 212*a* parallel to the conveyance direction and parallel to the vertical direction (see FIG. 8). The insulated pipe 222*c* according to the second embodiment is in communication with the second piping section 144, and like the insulated pipe 222*a* shown in FIG. 8, goes around and moves to the outside of the closed gas heater system 100. As shown in FIG. 9B, the insulated pipe 222*c* is disposed at upper and lower sides in a concave-convex shape in the vertical direction along the surfaces parallel with respect to the conveyance direction and parallel to the vertical direction.

In the second embodiment, the same effect as of the first embodiment can be obtained. That is, in the continuous heating furnace 200, temperature distribution in the furnace main body 212 is uniformized. In addition, since the exhaust heat of the exhaust gas is used, a new heat source is unnecessary. Accordingly, a decrease in thermal efficiency of the entire heating processing can be prevented.

Third Embodiment

Next, a heat insulating board 226*a* according to a third embodiment will be described. In the third embodiment, only the heat insulating board 226*a* is different from the first embodiment. For this reason, description of the same components as of the first embodiment will be omitted, and only the heat insulating board 226*a* will be described.

Figure 10A:
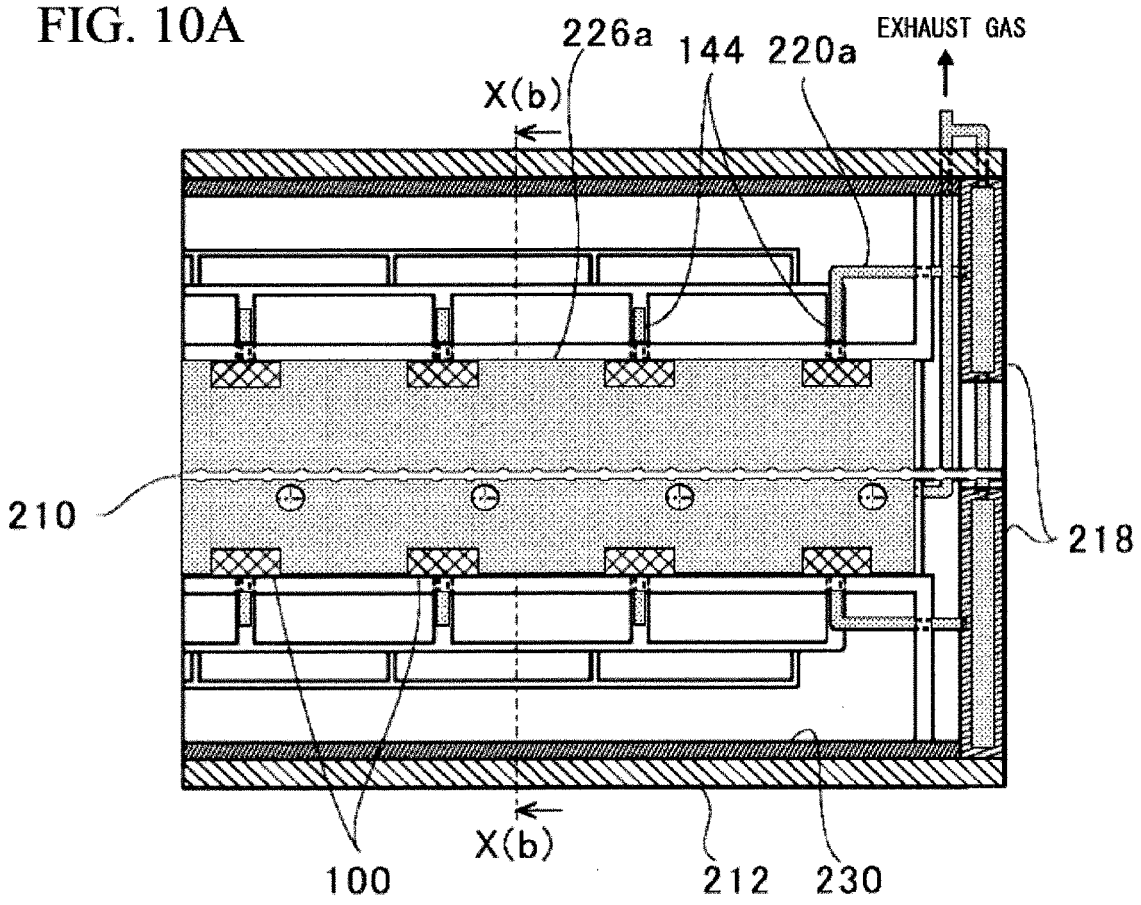
FIG. 10A is a view showing a heat insulating board according to a third embodiment of the present invention.
Figure 10B:
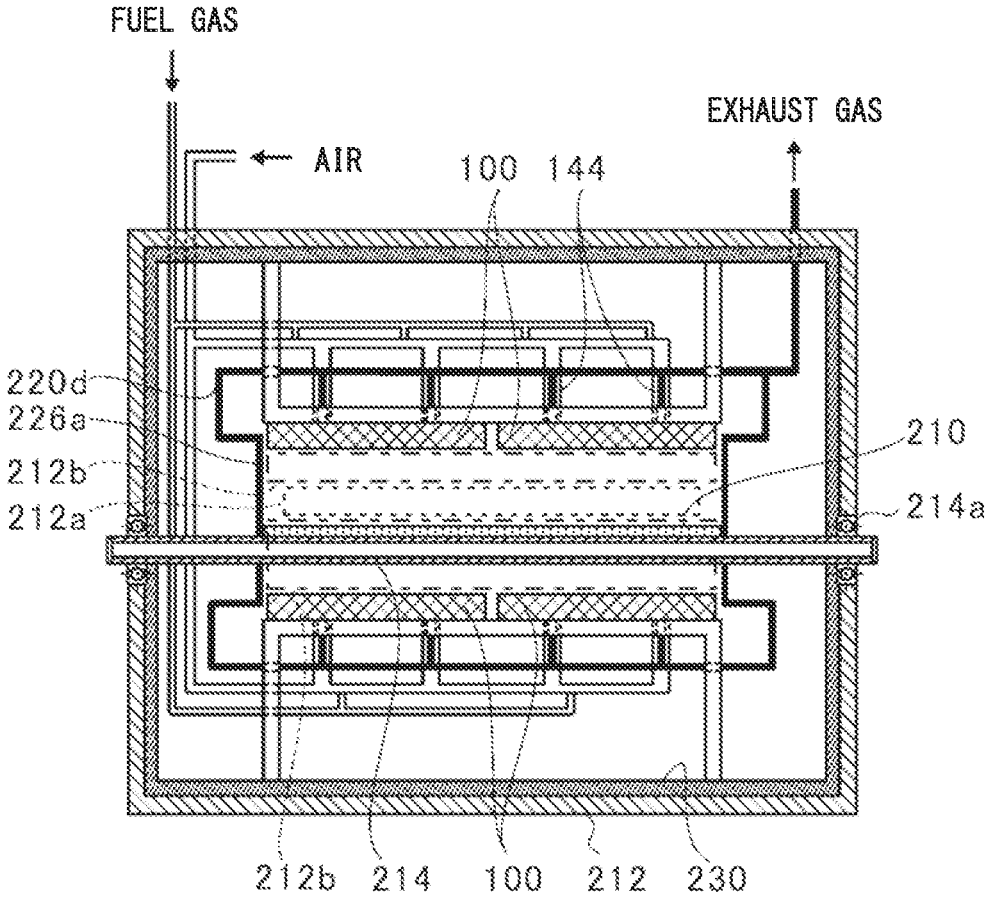
FIG. 10B is a view showing the heat insulating board according to the third embodiment of the present invention.

FIGS. 10A and 10B are views showing the heat insulating board 226*a* according to the third embodiment. FIG. 10A is an enlarged view of the same position as FIG. 7B, and FIG. 10B is a cross-sectional view taken along line X(b)-X(b) of FIG. 10A.

The insulated pipe 222*a* according to the first embodiment extends and repeatedly turns in the conveyance direction along side surfaces of the target space 212*a* parallel to the conveyance direction and parallel to the vertical direction. As shown in FIGS. 10A and 10B, the heat insulating board 226*a* according to the third embodiment forms a wall surface configured to cover side surfaces of the closed gas heater system 100 of an upper side in the vertical direction and the closed gas heater system 100 of a lower side in the vertical direction along the side surfaces parallel to the conveyance direction and parallel to the vertical direction. The heat insulating board 226*a* is configured to have a hollow inner space, and the inner space is in communication with the second piping section 144 via a communication pipe 220*d*. Accordingly, the exhaust gas is guided into the heat insulating board 226*a*.

In the embodiment, the target space 212*a* and the radiation space 212*b* are completely covered by the closed gas heater system 100 and the heat insulating board 226*a*.

In the third embodiment, the same effect as of the second embodiment can be realized.

Fourth Embodiment

Next, a heat insulating layer 228 according to a fourth embodiment will be described. In the fourth embodiment, only the heat insulating layer 228 is different from that of the first embodiment. Description of the same configuration as in the first embodiment will be omitted, and only the heat insulating layer 228 will be described.

Figure 11:
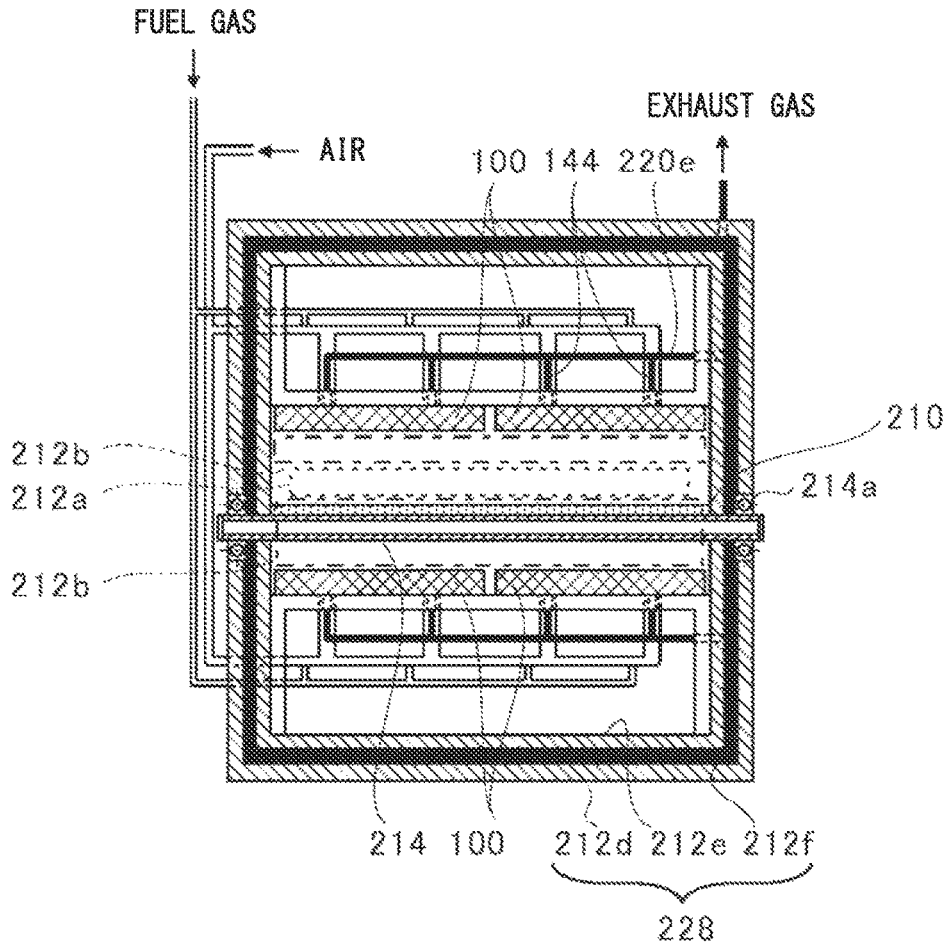
FIG. 11 is a view showing a heat insulating layer according to a fourth embodiment of the present invention.

FIG. 11 is a view showing the heat insulating layer 228 according to the fourth embodiment. In FIG. 11, a cross-sectional view of the same position as in FIG. 10B is shown. However, in the embodiment, a width of the furnace main body 212 is narrowed more than that of the third embodiment. As shown in FIG. 11, the furnace main body 212 of the continuous heating furnace 200 includes an outer wall 212*d* and an inner wall 212*e* spaced apart from the outer wall 212*d* in the inner space of the furnace main body 212. The heat insulating layer 228 is constituted by a void between the outer wall 212*d* and the inner wall 212*e*. The exhaust gas discharged from the closed gas heater system 100 is guided to the void (the heat insulating layer 228) between the outer wall 212*d* and the inner wall 212*e* via a communication pipe 220*e*.

In the fourth embodiment, the same effect as the second embodiment can be obtained. In particular, according to the continuous heating furnace 200 according to the fourth embodiment, the exhaust gas is evenly spread to the entire wall surface of the furnace main body 212. For this reason, a decrease in temperature throughout the entire inside of the furnace main body 212 can be suppressed.

Fifth Embodiment

Next, a heat insulating board 226*b* according to a fifth embodiment will be described. In the fifth embodiment, a configuration of the heat insulating board 226*b* and the number of closed gas heater systems 100 are different from those of the first embodiment. A description of the same configuration as that of the first embodiment will be omitted here, and only the heat insulating board 226*b* and the number of closed gas heater systems 100 will be described.

Figure 12A:
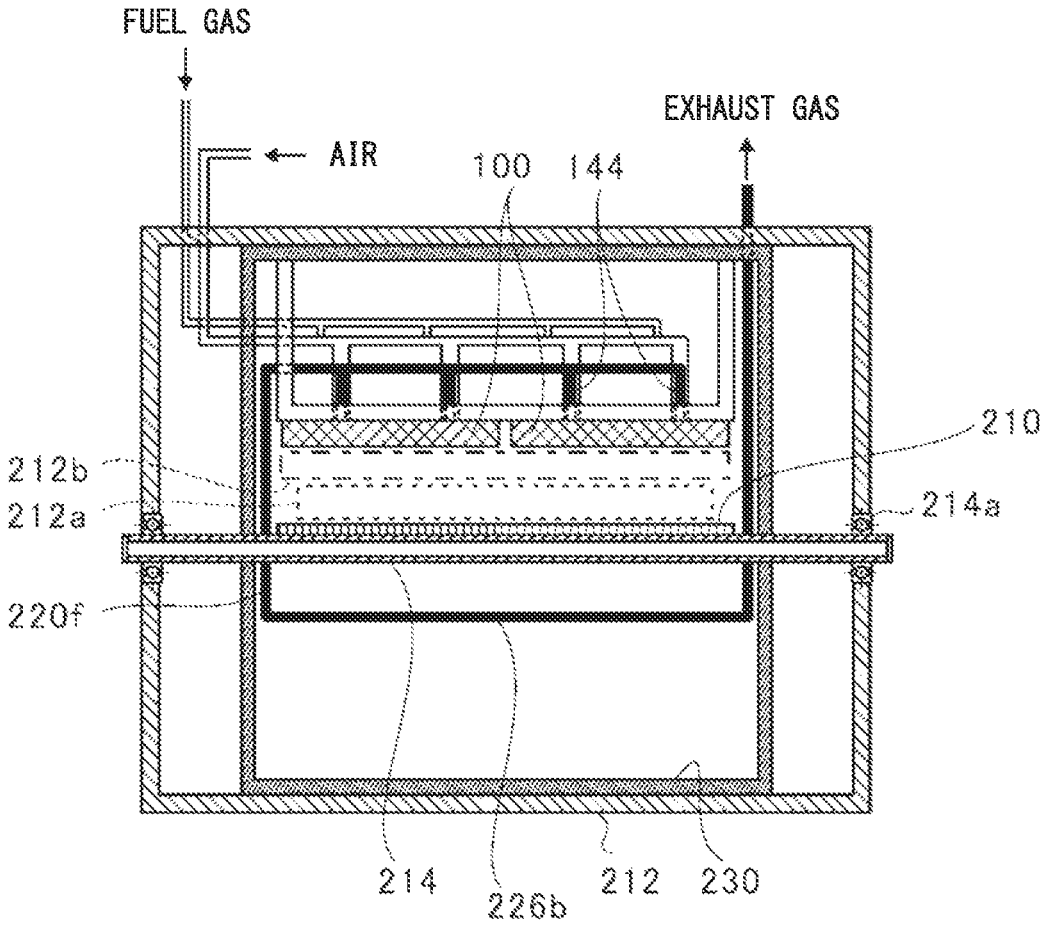
FIG. 12A is a view showing a heat insulating board according to a fifth embodiment of the present invention.
Figure 12B:
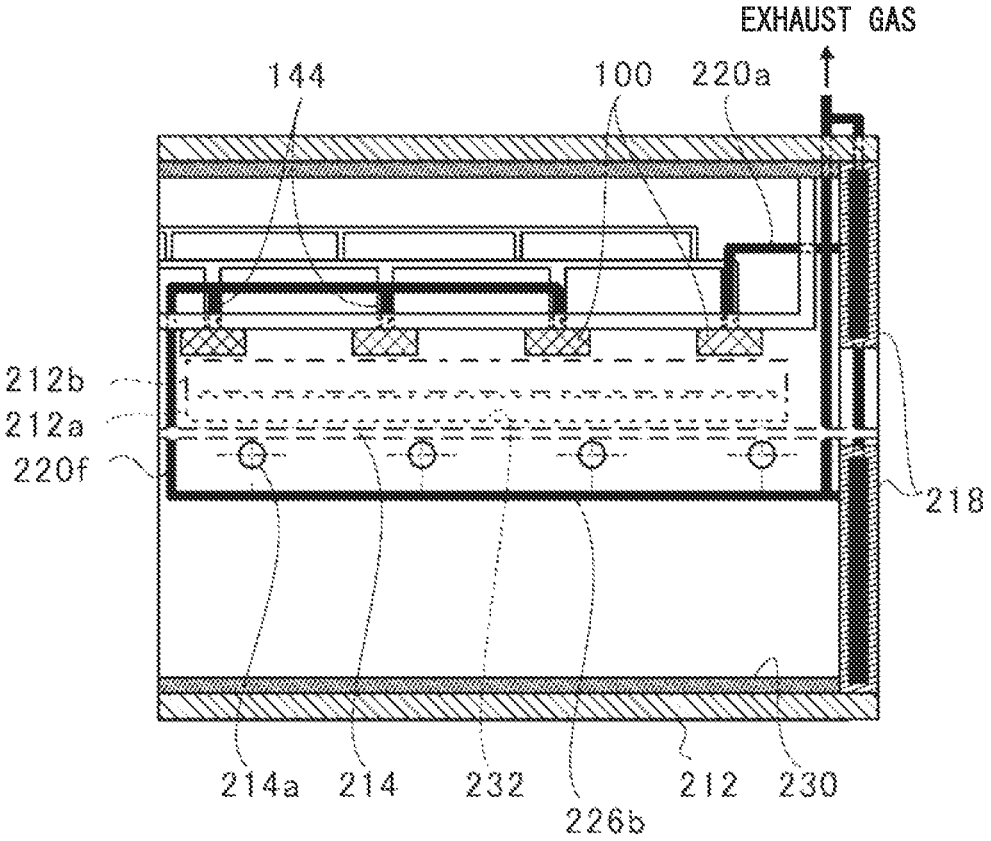
FIG. 12B is a view showing the heat insulating board according to the fifth embodiment of the present invention.

FIGS. 12A and 12B are views showing the heat insulating board 226*b* according to the fifth embodiment. FIG. 12A is a cross-sectional view of the same position as FIG. 7A, and FIG. 12B is an enlarged view of the same position as FIG. 7B.

In the above-mentioned first embodiment, the plurality of closed gas heater systems 100 are disposed to be opposite to each other to sandwich the target space 212*a*. In the fifth embodiment, the heat insulating board 226*b* is installed instead of the closed gas heater system 100 at a lower side in the vertical direction of the target space 212*a*. In addition, the number of closed gas heater systems 100 disposed in the furnace main body 212 is half that of the first embodiment. That is, as shown in FIGS. 12A and 12B, the heat insulating board 226*b* is disposed to be opposite to the closed gas heater system 100 to sandwich the target space 212*a*. The heat insulating board 226*b* is in communication with the second piping section 144 via the communication pipe 220*f*, and the exhaust gas is guided into a hollow inner space.

In the fifth embodiment, the same effect as of the second embodiment can be obtained. In particular, according to the continuous heating furnace 200 of the fifth embodiment, when the radiation heating is performed by only the closed gas heater system 100 from the upper surface side of the burning target, a decrease in temperature of the target space 212*a* of a lower surface side 232 (shown in FIG. 12B), which is not radiation-heated, can be suppressed.

In addition, while the communication pipe 220*f* goes around from a left side of the drawing of the target space 212*a* toward a lower side in the cross-section shown in FIG. 12A, in a cross-sectional view of another position, the communication pipe 220*f* goes around a right side of the target space 212*a*. As the communication pipe 220*f* goes around from the left and right sides of the target space 212*a*, temperature distribution in the horizontal direction of the target space 212*a* can be further uniformized.

The insulated wall, the insulated pipe, the heat insulating board and the heat insulating layer come in communication with the exhaust hole 142 of the closed gas heater 110 to form an exhaust heat transfer section into which the exhaust gas is guided. In addition, the exhaust heat transfer section such as the insulated wall, the insulated pipe, the heat insulating board, the heat insulating layer, and so on, is not limited to the above-mentioned position but may be installed at any portion in the furnace main body 212 except for the radiation space 212*b*.

In addition, in the above-mentioned embodiment, while the combustion chamber 136 is formed along the outer circumferential wall 122, the embodiment is not limited thereto. The combustion chamber 136 may be disposed in a space surrounded by the outer circumferential wall 122, the heating plate 126 and the disposition plate 120. However, since a preheating effect of the fuel gas by the exhaust gas is sufficiently secured, for example, the combustion chamber 136 may be installed at any position of one of the space between the heating plate 126 and the partition plate 124 and the space between the partition plate 124 and the disposition plate 120, closer to the outer circumferential wall 122 than an intermediate position from the introduction hole 132 formed in the disposition plate 120 to the outer circumferential wall 122.

Hereinabove, while exemplary embodiments of the present invention have been described with reference to the accompanying drawings, the present invention is not limited to the above-mentioned embodiments. It will be appreciated to those skilled in the art that various changes and modifications may be made without departing from the scope of the accompanying claims and these will fall into the technical spirit of the present invention.

INDUSTRIAL APPLICABILITY

According to the continuous heating furnace according to the present invention, it is possible to provide the continuous heating furnace capable of suppressing a decrease in temperature of the roller that supports the conveyance body and improving thermal efficiency.

DESCRIPTION OF REFERENCE SIGNS

110 closed gas heater
132 introduction hole
136 combustion chamber
138 discharge section
140 radiation surface
142 exhaust hole
200 continuous heating furnace
210 conveyance body
212 furnace main body
214 roller
216 exhaust pipe

The invention claimed is:

1. A continuous heating furnace comprising:

a conveyance body stretched in an endless shape and configured to convey a burning target;

a pair of first rollers configured to support a portion of the conveyance body and configured to move the conveyance body by rolling the pair of first rollers;

a furnace main body partially or entirely surrounding the conveyance body to form a burning space;

a plurality of second rollers provided between the pair of first rollers and configured to support a portion of the conveyance body in the furnace main body, each of the plurality of second rollers extending in a direction perpendicular to a conveyance direction of the burning target and parallel to a horizontal direction, each of the plurality of second rollers being configured to be rotatable around an axis perpendicular to the conveyance direction of the burning target and parallel to the horizontal direction;

one or more closed gas heaters having an introduction hole configured to introduce a fuel gas into a heater main body, a combustion chamber in which the fuel gas introduced from the introduction hole is combusted, a discharge section to which an exhaust gas generated by combustion in the combustion chamber is guided, a radiation surface heated by the exhaust gas flowing through the discharge section or combustion in the combustion chamber and configured to transfer radiant heat to the burning target, and an exhaust hole configured to exhaust the exhaust gas that heats the radiation surface to the outside of the heater main body, and disposed in the furnace main body;

an exhaust pipe in communication with the exhaust hole of the closed gas heater and through which the exhaust gas is guided; and an insulated pipe, wherein the exhaust pipe is configured to enable heat exchange with a protrusion portion of the plurality of second rollers protruding in a direction perpendicular to the conveyance direction of the burning target rather than with the conveyance body, the exhaust pipe surrounds and comes in partial contact with the protrusion portion of the plurality of second rollers to warm the plurality of second rollers by heat of the exhaust gas flowing through the exhaust pipe, and extends in a vertical direction, the exhaust gas exhausted from the closed gas heater system is guided through the insulated pipe, the insulated pipe is in communication with a piping section and goes around and moves to the outside of the closed gas heater system, and the insulated pipe extends and repeatedly turns in the conveyance direction along side surfaces of the target space parallel to the conveyance direction and the vertical direction.

2. The continuous heating furnace according to claim 1, wherein the insulated pipe is provided inside the furnace main body.

3. The continuous heating furnace according to claim 1, wherein the exhaust pipe comes in partial contact with an outer surface of the protrusion portion of the plurality of second rollers.

* * * * *